US005947722A

United States Patent [19]

Bauer

[11] Patent Number: 5,947,722

[45] Date of Patent: Sep. 7, 1999

[54] HEAT EXCHANGER FOR PARTICULATE MATERIAL

[75] Inventor: David P. Bauer, Xenia, Ohio

[73] Assignee: IAP Research, Inc., Dayton, Ohio

[21] Appl. No.: 08/888,742

[22] Filed: Jul. 7, 1997

[51] Int. Cl.[6] ..... H05B 3/78

[52] U.S. Cl. ..... 432/214; 392/484; 392/490

[58] Field of Search ..... 432/214, 215, 432/96, 97, 98, 99; 165/920, 4, DIG. 36, DIG. 9, DIG. 395, DIG. 396, DIG. 397; 392/484, 490, 494

[56] References Cited

U.S. PATENT DOCUMENTS

| | | | |
|---|---|---|---|
| 1,744,598 | 1/1930 | Wait | 392/484 |
| 2,514,722 | 7/1950 | Robinson | 432/215 |
| 2,887,304 | 5/1959 | Hilliard | 165/DIG. 396 |
| 2,917,284 | 12/1959 | Christian | 257/112 |
| 3,255,814 | 6/1966 | Zimmerman et al. | 165/87 |
| 3,442,065 | 5/1969 | Foras | 55/191 |
| 3,831,665 | 8/1974 | Knaus | 165/87 |
| 4,051,590 | 10/1977 | Halter et al. | 29/420.5 |
| 4,112,285 | 9/1978 | Pan et al. | 219/10.41 |
| 4,153,485 | 5/1979 | Ogata et al. | 148/126 |
| 4,188,184 | 2/1980 | Fornoni | 432/13 |
| 4,217,140 | 8/1980 | Waldhuter | 75/214 |
| 4,256,451 | 3/1981 | Johnson, Jr. | 432/97 |
| 4,276,020 | 6/1981 | Shibuya et al. | 432/14 |
| 4,343,988 | 8/1982 | Roller et al. | 392/484 |
| 4,366,804 | 1/1983 | Abe | 126/263 |
| 4,469,925 | 9/1984 | Toshiro et al. | 219/10.49 |
| 4,515,629 | 5/1985 | Dizek et al. | 75/0.5 B |
| 4,590,033 | 5/1986 | Chapet | 419/9 |
| 4,807,342 | 2/1989 | Lapeyre | 29/157.3 D |
| 4,889,665 | 12/1989 | Uda et al. | 264/10 |
| 4,962,291 | 10/1990 | Fujita et al. | 219/10.49 |
| 5,134,260 | 7/1992 | Piehler et al. | 219/10.41 |
| 5,169,572 | 12/1992 | Matthews | 264/27 |
| 5,213,816 | 5/1993 | Smyth, Jr. et al. | 425/78 |
| 5,320,168 | 6/1994 | Haight | 165/920 |
| 5,397,837 | 3/1995 | Arjunan | 525/72 |
| 5,401,937 | 3/1995 | Nagano | 219/544 |
| 5,574,955 | 11/1996 | Stromgren et al. | 419/30 |
| 5,611,139 | 3/1997 | Chelluri et al. | 29/744 |
| 5,611,230 | 3/1997 | Chelluri et al. | 72/56 |
| 5,689,797 | 11/1997 | Chelluri et al. | 419/38 |

FOREIGN PATENT DOCUMENTS

| | | | |
|---|---|---|---|
| 2527787 | 1/1976 | Germany . | |
| 3816819 | 11/1989 | Germany | 392/484 |
| 60-234901 | 11/1985 | Japan . | |
| 2009900 | 6/1979 | United Kingdom . | |
| 2153055 | 8/1985 | United Kingdom . | |

*Primary Examiner*—Teresa Walberg
*Assistant Examiner*—Jiping Lu
*Attorney, Agent, or Firm*—Jacox, Meckstroth & Jenkins

[57] ABSTRACT

A particulate material heating system and method for heating particulate material having a core which is heated to a predetermined temperature. The core has a plurality of serpentine passages which receive particulate material from a metering device having a plurality of gears which meter the particulate material into the serpentine passages. Gravity causes the particulate material to pass through the serpentine passages such that the particulate material is agitated as it passes through the serpentine passages, thereby causing a substantial portion of the particulate material to come into contact with the core and become heated.

14 Claims, 10 Drawing Sheets

PM
24
89
90
90a
120
VIBRATOR
30
27
21
89
99
101
91
6
99
DRIVE MOTOR
97
15
3
95
3
15
ENERGY TO HEATERS 15
3b
3a
CONTROL SYSTEM 75
SENSOR
70
95
97

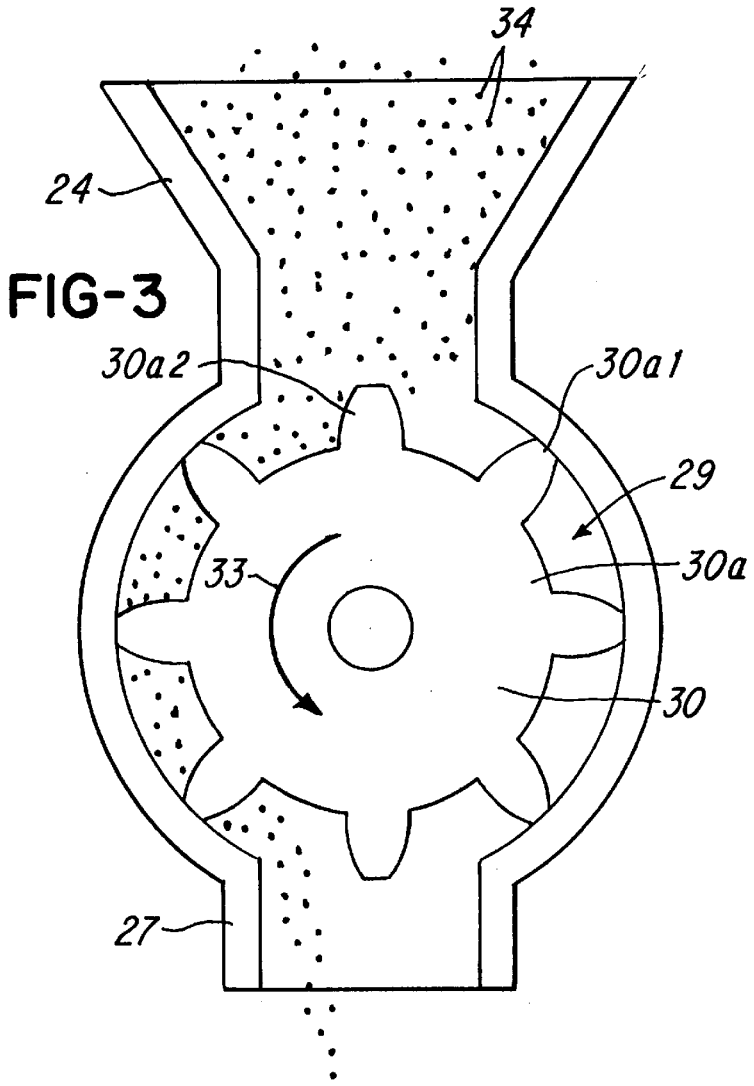
FIG-3
FIG-5A
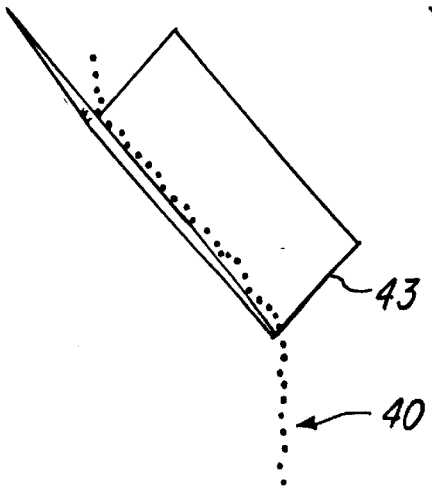
FIG-5B
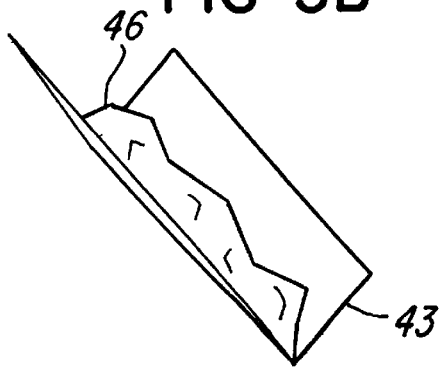

30a
30b
30c
30d
24
30
90
89
89
91
27
6
4A
3
A
P
3

6
37
37

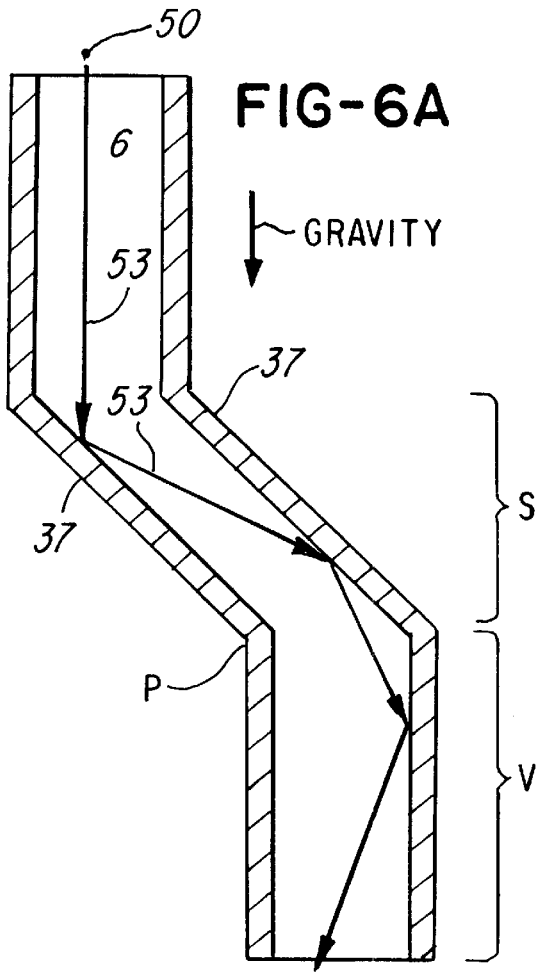
FIG-6A
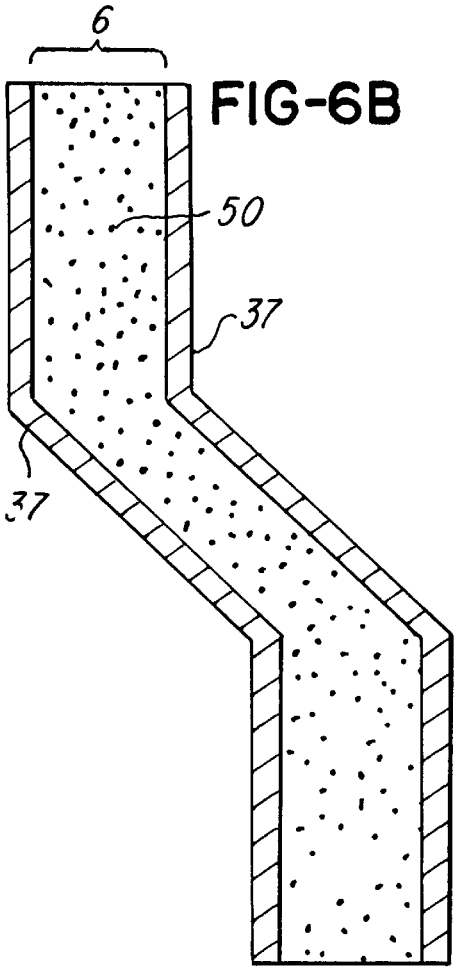
FIG-6B
FIG-7
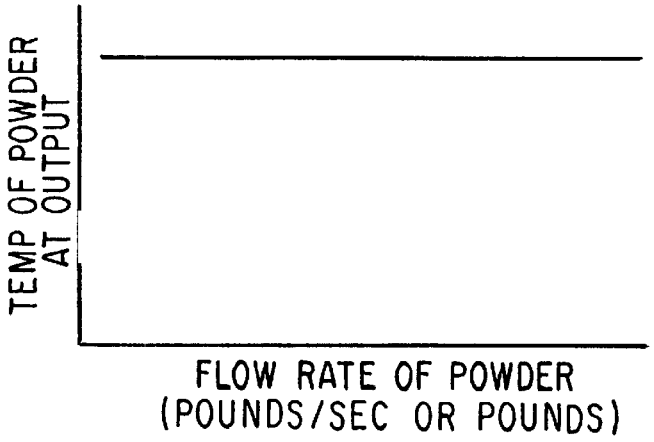

37
6
31

37
31

37
V+
31

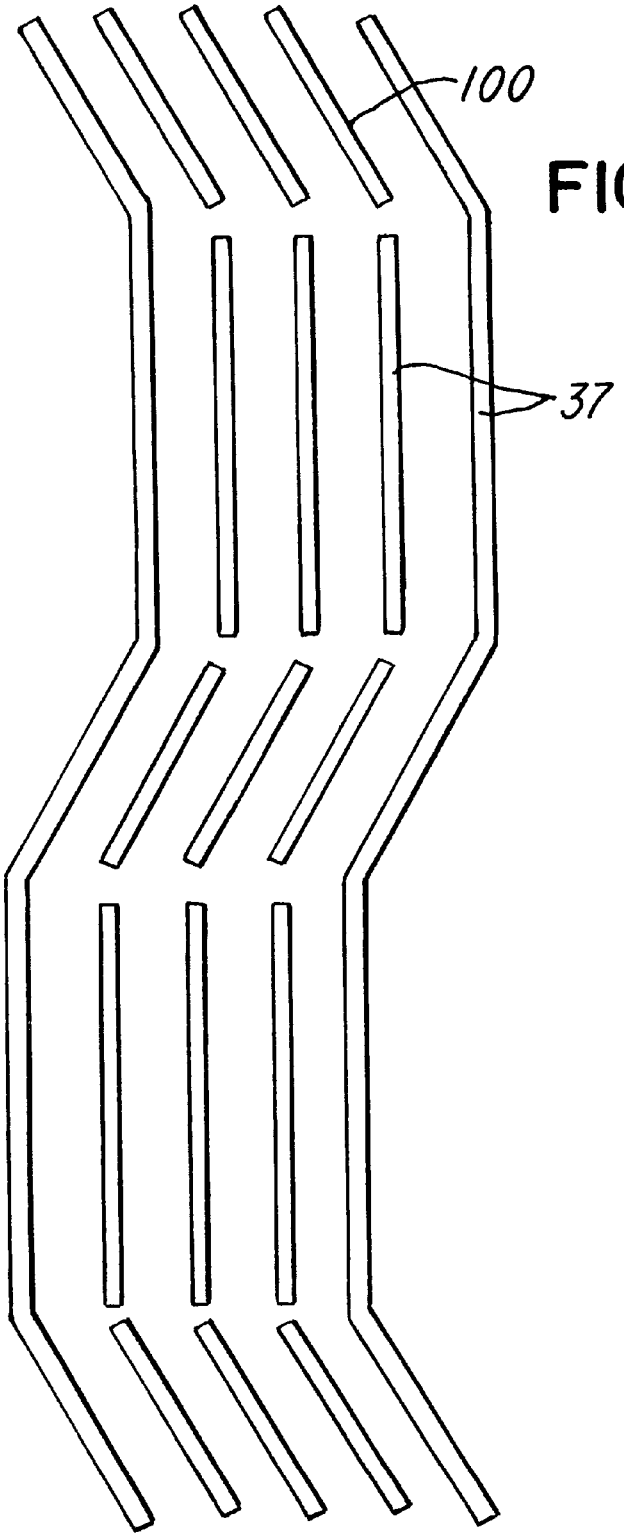
FIG-10A
FIG-10B
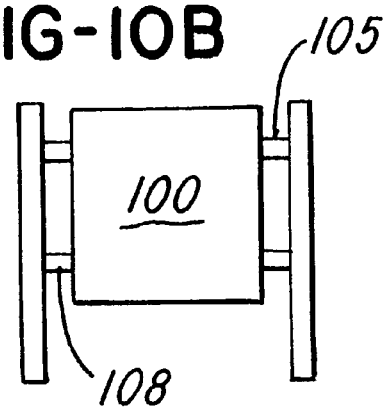

HEAT EXCHANGER FOR PARTICULATE MATERIAL

This invention was made with United States Government support under Award No. 70NANB5H1145 awarded by The National Institute of Standards and Technology (NIST). The United States Government has certain rights in the invention.

BACKGROUND OF THE INVENTION

1. Field of the Invention

This invention concerns a heater or heat exchanger for heating particulate material and particularly suited for use in a sintering process.

2. Description of Related Art

Metallic parts can be fabricated using, for example, a sintering process. Powdered metal is packed or consolidated into a mold and then pressure and/or heat is applied, thereby causing the particles of metal powder to fuse together. It has been found that the consolidation step is facilitated if the particulate material is pre-heated prior to sintering.

A common pre-heating process involves transporting the metal powder through a heated tube, using an auger or a heated auger which revolves within the tube. The revolving auger causes the metal powder to tumble within the heated tube, thereby picking up heat from the tube, as the auger advances the powder toward an output end of the tube.

However, a problem with this heating process is that the powder does not heat uniformly, tends to "cake" or lump together. It is also found that the caking limits the maximum temperature to which the powder can be heated.

Various types of heating devices are shown in U.S. Pat. Nos. 2,917,284, 3,255,814, 3,831,665, 4,051,590, 4,153,485, 4,276,020, 4,469,925, 5,169,572, 5,213,816, and 5,401,937. Some or all of these devices suffer in that they are relatively complex or complicated in design and may not uniformly heat the particulate material as desired.

What is needed, therefore, is a device which is simple in design and construction which will be relatively inexpensive to manufacture, or produce; and which will improve the heating of materials passing therethrough.

SUMMARY OF THE INVENTION

A primary object of the invention is to provide an improved heater or heating means for particulate material which is simple in design and construction.

Another object of the invention is to provide a heater for particulate material which can heat small or large quantities of metal.

Still another object of the invention is to provide a heater for particulate material which can heat the particulate material uniformly.

In one form of the invention, metal particulate material is carried through a heated serpentine tube, under the influence of gravity.

In one aspect, a heating apparatus for particulate material comprises a chute for receiving the particulate material and a heating system effective to heat a quantity of particulate material, and deliver a desired percent of said quantity as heated particulate material.

In another aspect, an apparatus for heating particulate material comprises a hopper for storing the particulate material, a metering device for withdrawing metered amounts of particulate material from the hopper and delivering the metered amounts to an input port, a plurality of elongated, serpentine channels positioned such that ends of the channels connect with the input port, to receive the metered amounts of particulate material, and gravity causes the particulate material to tumble through the serpentine channels, and a heater for heating the serpentine channels to, thereby, deliver heat to the particulate material therein.

Other objects and advantages of the invention will be apparent from the following description, the accompanying drawings, and the appended claims.

BRIEF DESCRIPTION OF ACCOMPANYING DRAWINGS

FIG. 3 illustrates the metering wheel 30 of FIG. 2;

FIGS. 5A and 5B illustrate two ways in which particulate material can pass through a chute 43;

FIGS. 6A and 6B illustrate two ways in which particulate material can pass through passage 6 of FIG. 2;

FIG. 7 illustrates a relationship between a powder flow rate and temperature;

FIGS. 10A and 10B illustrate yet another form of the invention;

DETAILED DESCRIPTION OF THE PREFERRED EMBODIMENTS

Figure 1A:
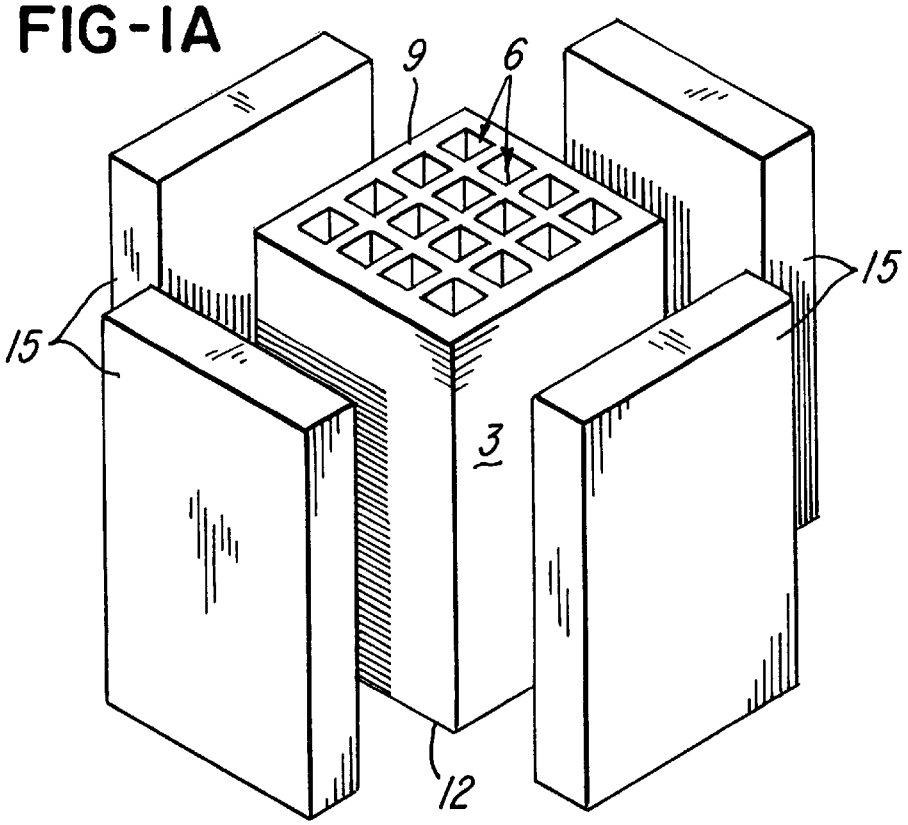
FIGS. 1A and 1B illustrates one form of the invention.
Figure 1B:
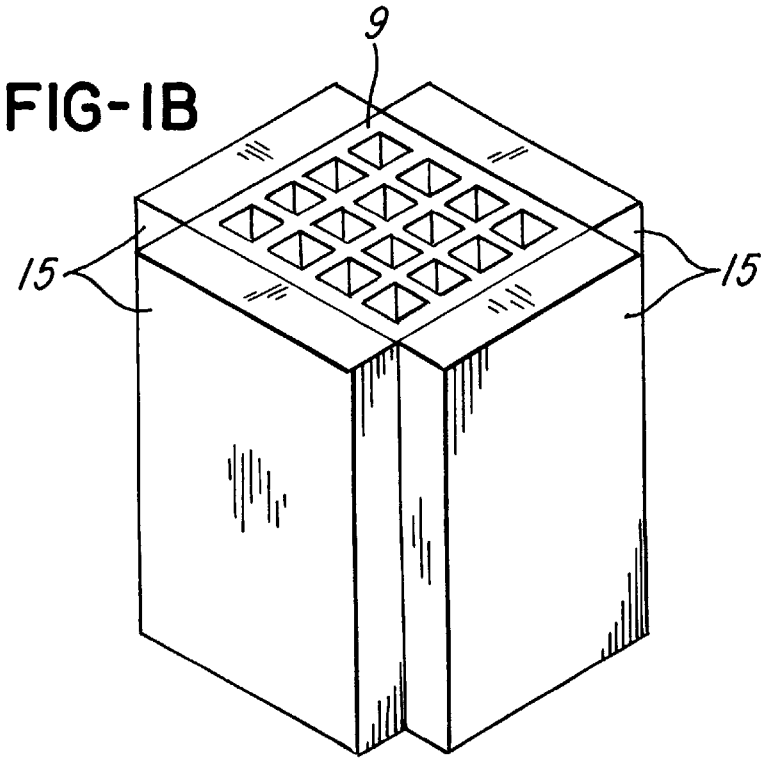

FIG. 1 illustrates one form of the invention. A core 3 in FIG. 1A contains multiple channels or passages 6 which extend from the top 9 to the bottom 12. The core 3 is made of aluminum and is surrounded on at least two sides by heating elements 15. It should be appreciated that other materials could be selected, depending upon the nature of the particulate material PM and its heating requirements. Heating elements 15 can take the form of model number Vulcan 750W 240V 3605K61, available from McMaster-Carr Supply Co. located in Chicago, Ill. FIG. 1B shows the apparatus in assembled form.

In general, particulate material PM (FIG. 2), such as a powdered metal material, is guided or dropped into the passages 6 at the top 9 during heating and falls out through the bottom 12. While in transit through the passages 6, the particulate material PM becomes heated.

Figure 2:
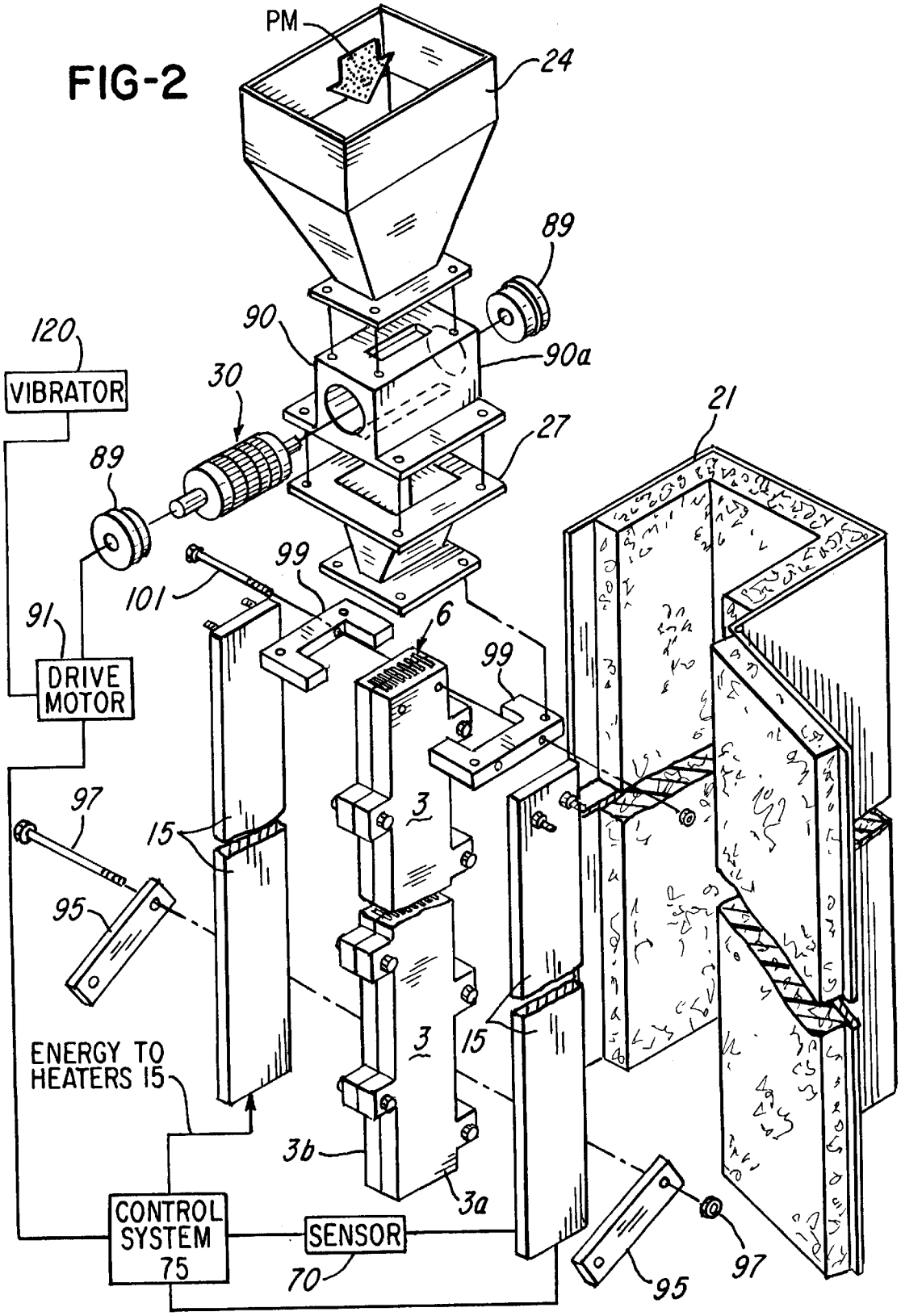
FIG. 2 illustrates another form of the invention.
Figures 4, 4A:
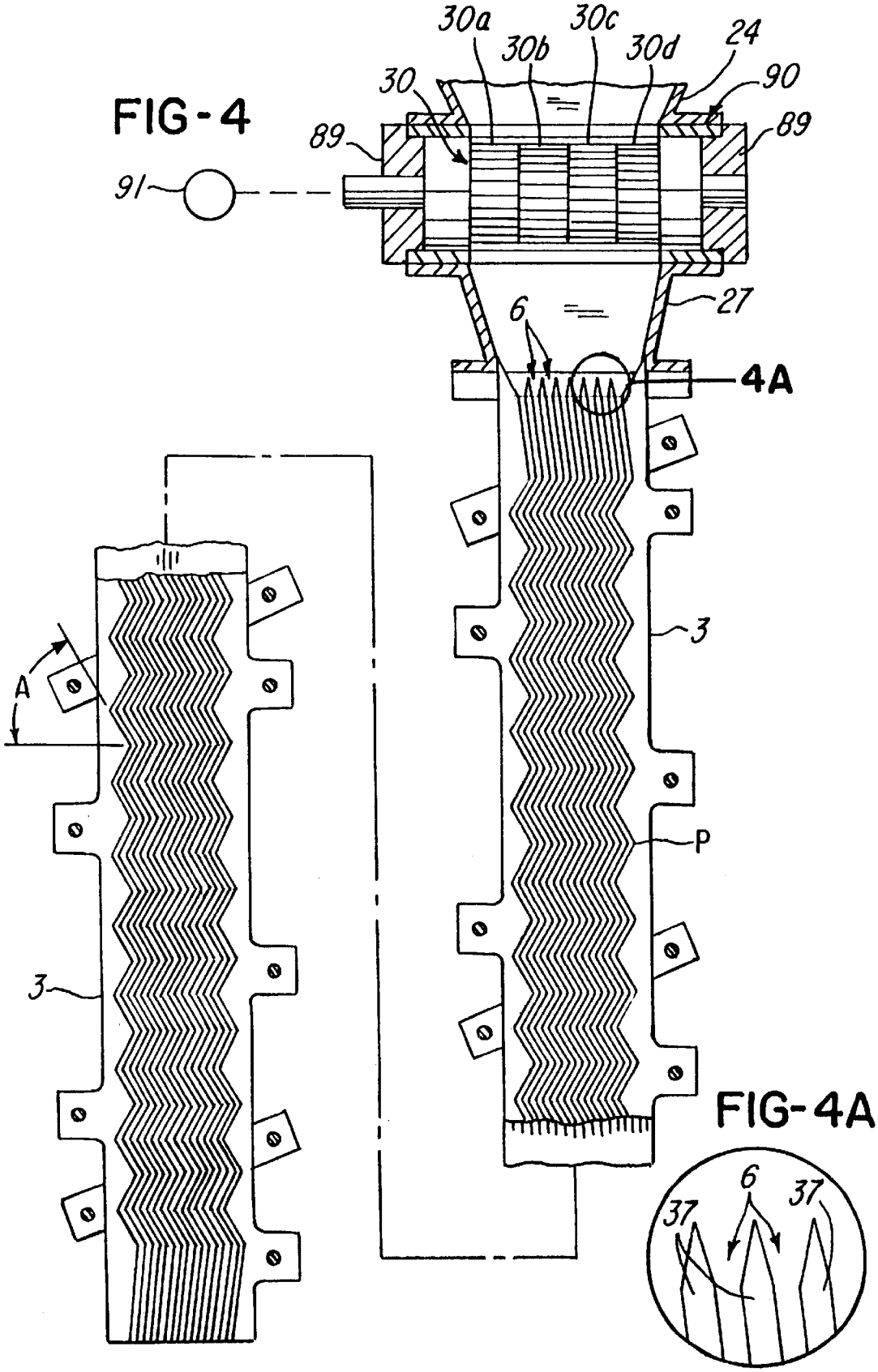
FIG. 4 illustrates serpentine channels contained within core 3 of FIG. 1.
FIG. 4A is an enlarged, fragmentary view showing details of the openings of several passageways taken on line 4*a* in FIG. 4.

FIG. 2 illustrates another form of the invention which shows the core 3, passages 6, and the heating elements 15. The heating elements 15 are fastened to the core 3 using brackets 95 and fasteners 97. The core-heating element assembly is contained within an insulated jacket or chamber 21. As shown in FIGS. 2 and 4, the core 3 comprises a pair of complementary plates or walls 3*a* and 3*b* secured together with suitable fasteners or screws to define the passages 6.

Particulate material PM contained within a hopper 24 is metered into a chute 27 by a metering device or means 90 comprising a housing 90*a* (FIG. 2) for housing a pair of bearings 89 for rotatably securing a metering wheel 30 which is driven by a drive motor 91 coupled to a controller 100. FIG. 3 shows the metering wheel 30 in schematic cross-sectional view. Rotation of the wheel 30, as indicated by arrow 33, carries the particulate material PM from the hopper 24 to the chute 27. The chute 27 delivers the particulate material PM to the passages 6 in FIG. 2.

It should be appreciated that the wheel 30 may comprise a plurality of gears, such as gears 30*a*, 30*b*, 30*c* and 30*d* whose teeth (such as teeth 30*a*1 and 30*a*2 in FIG. 3) are spaced to define a cavity or volume 29 (FIG. 3) which defines the amount of particulate material PM to be metered. By simply substituting gears with a different gear having different gear characteristics (such as tooth pitch, pitch diameter and the like), the metering device 90 can be mechanically programmed to meter different quantities of particulate material PM into the channels or passages 6. In the embodiment being described, the controller 100 may be programmed with a gear speed and gear rotation angle to further facilitate controlling the amount of particulate material PM passing through the passages 6.

A collar 99 is secured to core 3 with a fastener and provides means for securing the chute metering device 90 and hopper 24 thereto.

The drive motor 91 may be a stepper motor, such as Model No. Zeta 83-135 available from Parker Motor & Control Corp. of Rohnert Park, Calif. The motor 91 is coupled to a control system or panel 75 which is also coupled to heating elements 15 and which is capable of controlling the operation thereof.

The passages 6 are preferably serpentine in shape, as indicated in FIG. 4, and define a relatively large heating surface area. Because of the larger surface area, it has been found that temperature of the particulate material PM processed is affected by neither the quantity of the particulate material PM processed nor the processing of particulate material PM at different or non-steady cycle times, such as during start up. Baffles 37 which define the passages 6 are pointed or beveled at their ends, as indicated to prevent accumulation of particulate material PM which would occur if the tops were flat. Some significant characteristics of this serpentine shape will be explained with reference to FIGS. 5 and 6.

FIG. 5 provides an analogy showing two extreme cases. In FIG. 5A, a stream of particulate material PM or particles 40 falls through a heated sheet metal chute 43. The flow rate is sufficiently small that every metal particle remains in contact with the chute 43. The heat transfer to the particles is very efficient because every particle is in direct contact with a source of heat, namely, the chute 43.

In FIG. 5B, the flow rate is larger. A quantity or mass 46 of metal particles slides through the chute 43. However, the mass 46 acts generally as a solid body, with the possible exception of particles located at the wall of the chute 43. These latter particles may roll, tumble and slide, but, nevertheless, the overall mass 46 slides down the chute as a single body. The particles contained deep within the body of the mass 46 are not in direct contact with the chute 43, and thus do not directly absorb heat from the chute 43. The heat transfer to the particles comprising the mass is less efficient than in FIG. 5A.

The serpentine shape of the passages 6 in FIG. 4 can provide a heat transfer and agitation mechanism similar to that of FIG. 5A. For example, in FIG. 6A, a single metal particle 50 can follow the path indicated by arrows 53. That particle repeatedly contacts the walls 37 of the passage 6. In contrast, if the passage 6 were completely filled with particles 50, as in FIG. 6B, then every particle would not contact the walls 37 of the passage.

Therefore, if the flow rate of particles is kept at an appropriate level (in a manner described below), the mechanism of FIG. 6A will dominate. Either all or most of the particles will bounce off of or slide along the walls 37 of the passage 6 and absorb heat directly from the walls 37.

This mechanism can be described by terminology used in the art of heat transfer. In that art, at least two types of fluid cooling are known, namely, impingement cooling and film cooling. In impingement cooling, a stream of cooling fluid is directed perpendicularly, or nearly so, onto a surface to be cooled. Spraying a garden hose onto a window provides an example.

In film cooling, a film fluid is flowed over a surface. Placing a garden hose at the top of a playground slide, and flowing water down the slide provides an example. The water forms a cooling film on the slide surface.

Under the mechanism of FIG. 6A, impingement cooling, in effect, takes place. The particle 50 impinges upon the walls 37 of the passage 6 and absorbs heat from the wall 37. Since, under this invention, the goal is to heat the particles 50, rather than to cool the wall 37, the process will be termed impingement heating, rather than impingement cooling.

The serpentine passages 6 in FIGS. 4 and 6A provide a significant operational advantage, namely, that arbitrarily small amounts of particulate material PM can be heated. In principle, the single particle 50 in FIG. 6A can be heated. In practice, a more convenient small amount may be heated, such as one or even a few grams. Not only can arbitrarily small amounts be heated, but substantially all particulate material PM which is heated will be recovered.

CONTROL SYSTEM AND MODES OF OPERATION

The particulate material PM which initially flows through the serpentine channels 6 in FIG. 3 acts as a coolant and cools the core 3. Consequently, the particulate material PM which followed the initial particulate material PM will contact a cooler core and may not be heated to the same temperature. In the embodiment being described, the heating elements 15 are sized at an output power level which will insure that cores 3 maintain the desired temperature, regardless of the quantity of particulate material PM processed. In one example, the heating elements 15 were energized to heat the core 3 to about 160° C. and the core 3 heats particulate material PM, such as Ancordense™, to about 150° C.

Several other measures can be taken to counteract this situation, depending upon the mode of heating undertaken. For example, the system of FIG. 2 can be initially calibrated. In calibration, a given amount of power is supplied to the heating elements 15 and a plot is derived of the type shown in FIG. 5. Further, two types of plot can be derived. One type is for steady-state operation, wherein particulate material PM is metered to the passages 6 on a continuous basis for an extended time. The other type is for transient operation, wherein a single slug of particulate material PM is delivered to the passages 6.

In both types of plot, for a given level of supplied power, the temperatures of the particulate material PM produced is measured, for both the steady-state case and the transient case. The units in the plot of FIG. 7 reflect the two different cases: "POUNDS/SEC" refers to the steady-state case and "POUNDS" refers to the transient case.

Additional plots can be derived for different amounts of power supplied to the heating elements 15.

Once the control system 75 has been calibrated by generating the appropriate number of plots, then a given particulate material PM temperature may be selected by the user. Using the plots, a proper energy level for the heating elements 15 is selected, together with a proper flow rate of particulate material PM, either a steady-state or transient.

In order to monitor particulate material PM temperature in general, the control system 75 may include a temperature sensor 70 (FIG. 8B) for measuring a temperature of the output particulate material PM. In response, the control system 75 controls the power delivered to the heating elements 15, thereby controlling the temperature of the core 3 and the particulate material PM temperature.

Numerous types of control strategies, known in the art, can be implemented by the control system 75, depending upon the behavior desired. For example, the control system 75 can be ON-OFF type, in which the control system 75 acts like a simple thermostat. Alternatively, the control system 75 can be of the proportional type, integral type, differential type, or any combination of these types, such as proportional-integral-differential (PID).

Some control systems are described, for example, in *System Dynamics,* by K. Ogata (Prentice Hall, 1992), ISBN 0-13-855941-4, particularly Chapter 9.

ADDITIONAL FORMS OF THE INVENTION

Figure 8B:
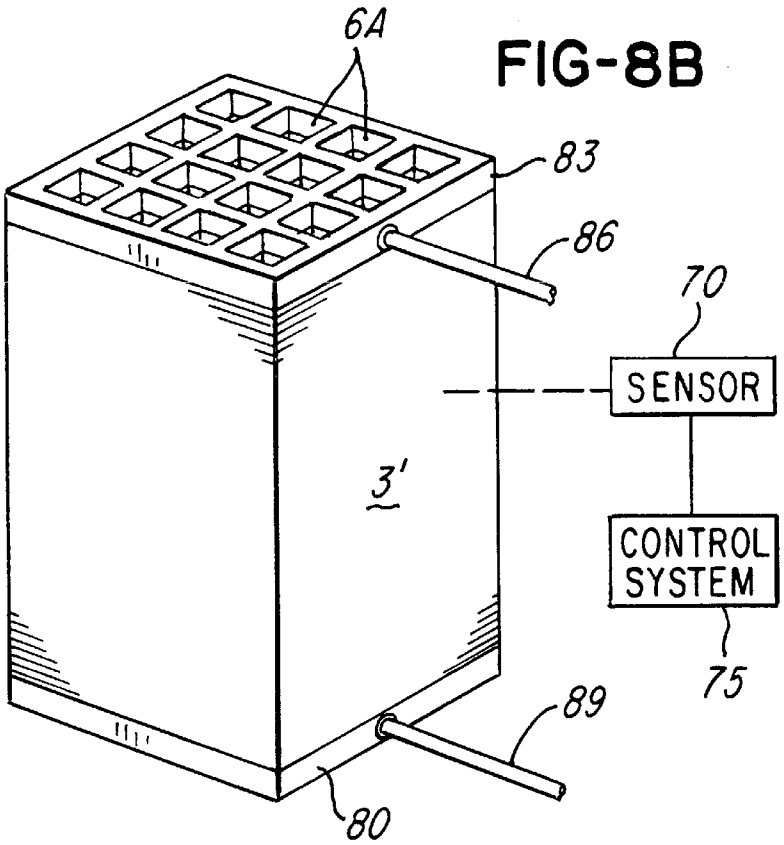
FIGS. 8A and 8B illustrate another form of the invention.
Figure 8A:
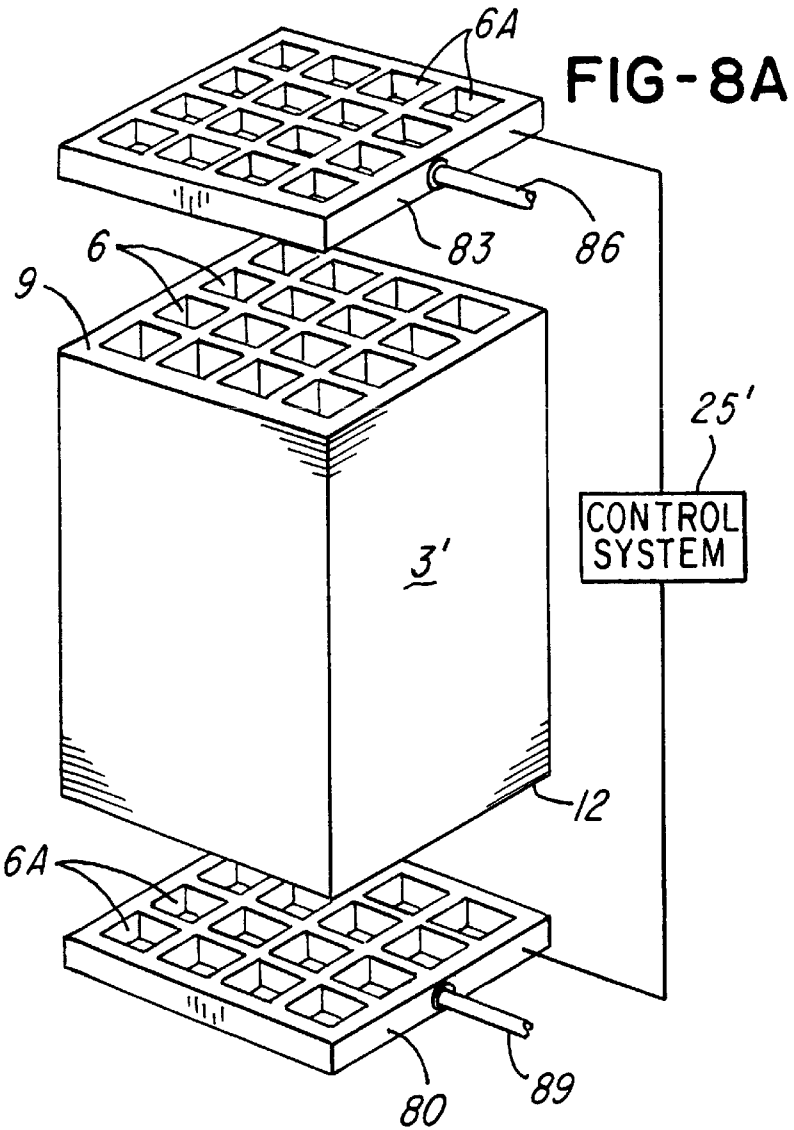

1. FIGS. 8A and 8B illustrates a core 3' which is constructed of a resistive alloy, such as NiChrome or another alloy. Electrodes 83 and 80 in FIG. 8A are coupled to an energizer or control system 75' and are of low resistivity, are attached to the core 3', and contain apertures 6A which in cross-section match passages 6 in size, shape and position. The combination of passages 6 and apertures 6A forms continuous passages of the type shown in FIG. 4.

The electrodes 80 and 83 are low-resistivity in order to apply a uniform voltage across the top 9 and bottom 12 of the core 3' in FIG. 8A. The electrodes are fed current through conductors 86 and 89. In this embodiment, heat is generated through Joule heating of the core 3' itself. Thus, it should be appreciated that external heaters 15 in FIG. 2 are not needed.

Figures 9A, 9B, 9C:
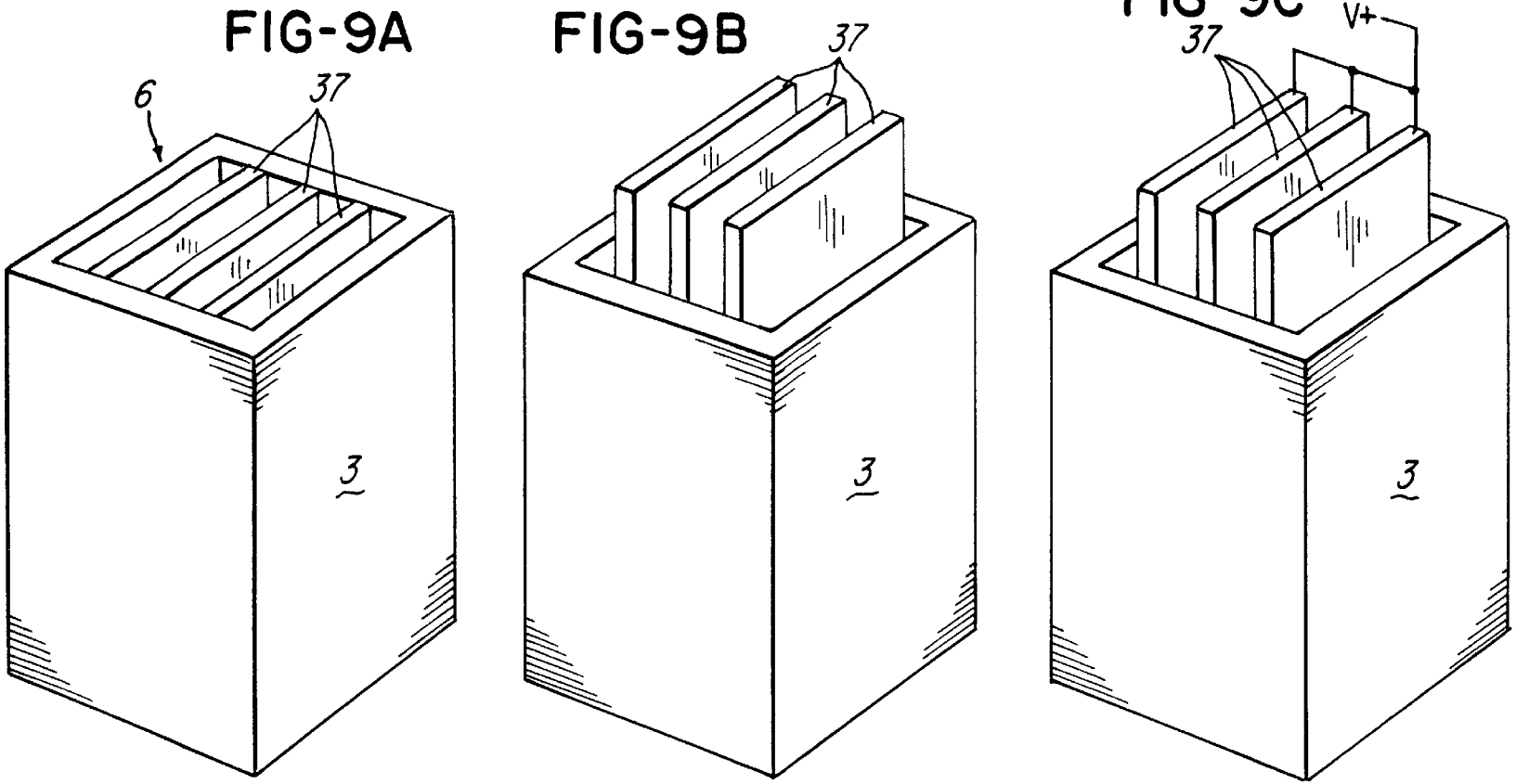
FIGS. 9A–9C illustrate yet another form of the invention.

2. The baffles 37 in FIG. 4 may be removable, as shown in FIG. 9B. In addition, they can be resistive elements and act as heaters when energized by a power source, as indicated as "V+" in FIG. 9C.

3. It is possible that the major amount of heat is delivered by the non-vertical sections of the wall 37 in FIG. 6A. If so, then those sections can be replaced by heating plates 100 (FIGS. 10A and 10B). The plates are supplied with current by conductors 105 and 108.

Figure 11B:
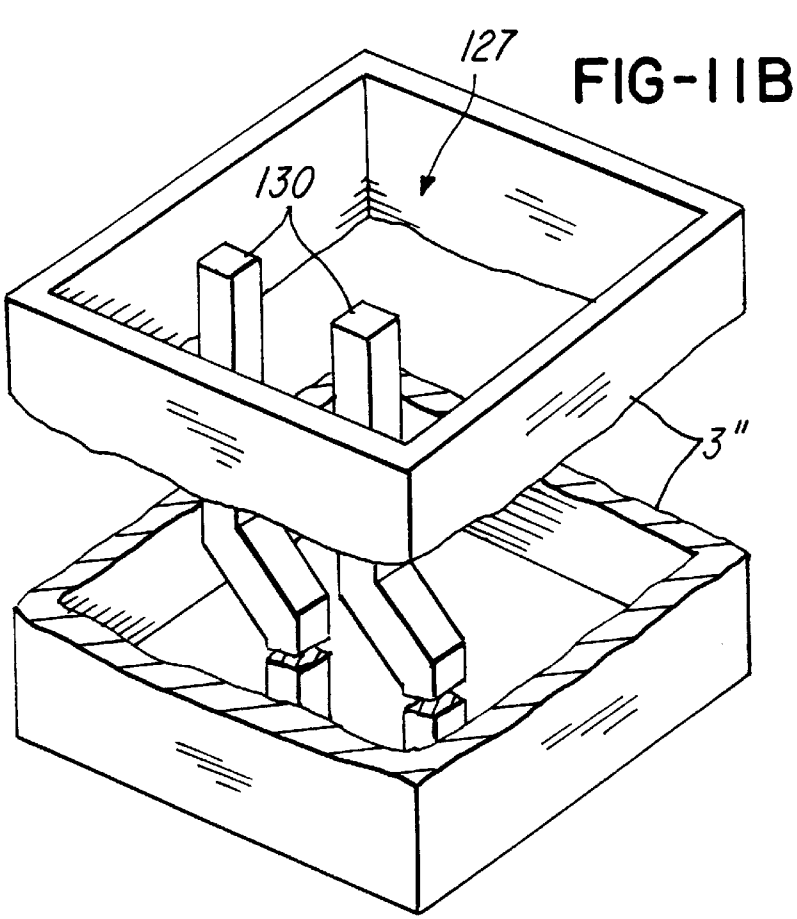
FIGS. 11A and 11B illustrate yet another form of the invention.
Figure 11A:
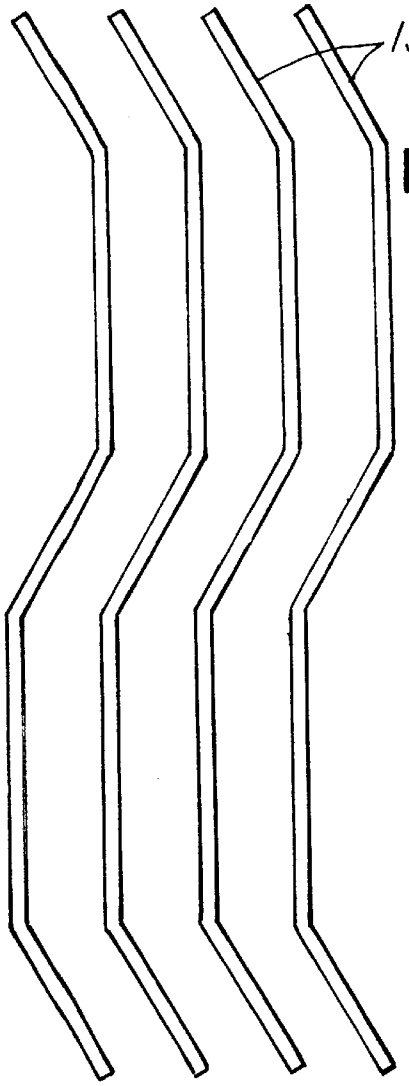

4. FIG. 11 illustrates yet another type of core 3". In FIG. 11B, the core 3" contains a large hollow channel 127. It contains elongated, serpentine, resistive heating elements 130, only two of which are shown. The heating elements 130 are shown in cross-section in FIG. 11A. The heating elements 130 in FIG. 11B are powered by suitable power leads (not shown).

5. A vibrator 120 can be added in FIG. 2, to facilitate flow of the particulate material PM through the core 3. One type of vibrator comprises an eccentric weight situated on or carried by a shaft of drive motor 91 used to drive roller 30.

6. It is possible that the serpentine tubes of FIG. 4 can be straightened so that the metal particles follow a long, continuous, sloping passage, as though traveling a long, slanted, straight pipe. In this case, the particle travel is analogous to that if the chute 43 of FIG. 5A were made very long.

However, with this arrangement, the induced tumbling which occurs at points P in FIG. 4 and FIG. 6A will be eliminated. This tumbling is desired because it assures that if a body of particle, such as body 46 in FIG. 5B, flowing through the serpentine path of FIG. 4 will be agitated and particles not in contact with the walls 37 of the passage will be forced into contact.

Figure 12:
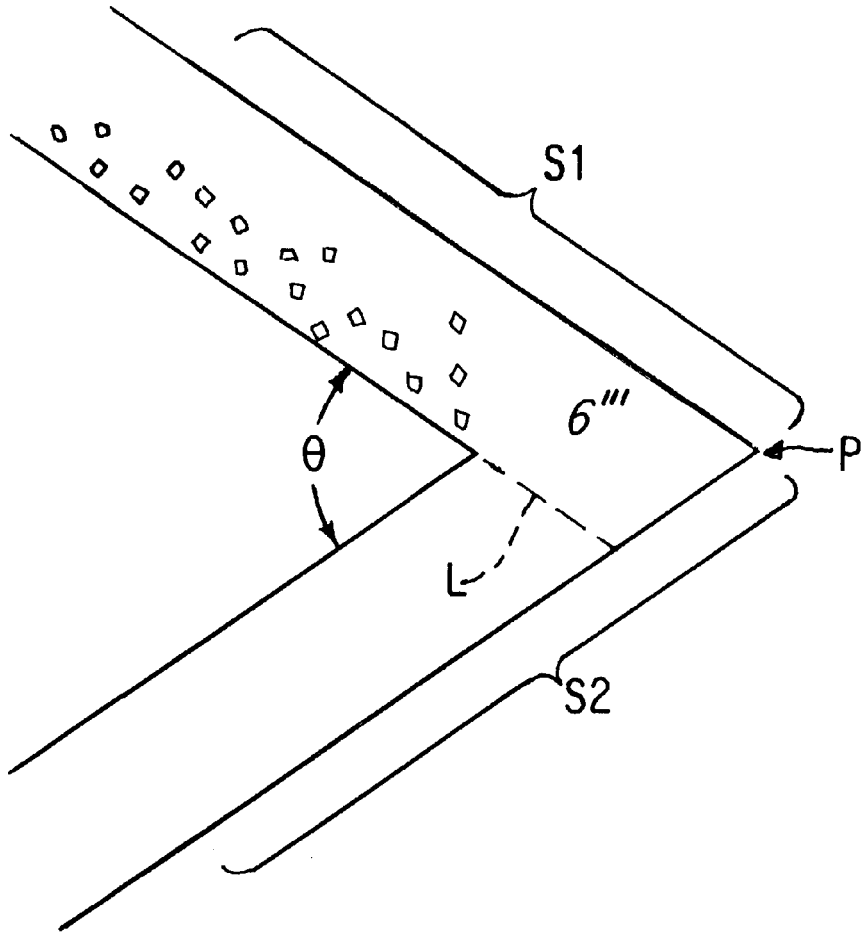
FIG. 12 illustrates a particulate material fall.

From another perspective, points P illustrate stationary "particulate material PM falls" which are analogous to waterfalls. FIG. 12 illustrates a particulate material PM fall. At the particulate material PM falls, vertical support of section S1, indicated by dashed line L, of the particulate material PM terminates and the particulate material PM tumbles into the next section S2 of the serpentine passageway 6"'. The particulate material PM falls induce agitation into the particulate material PM, but solely because of the force of gravity.

ADDITIONAL CONSIDERATIONS

1. A typical particulate material PM to be heated by the invention is that sold as Ancordense™ available from Hoeganaes Corporation located in Riverton, N.J.

2. As stated above, inventions delivers substantially all particulate material PM which it receives, and traps no metal within the core 3. As a specific example, if 100 grams of particulate material PM are received, then 100 percent of that particulate material PM is delivered.

From another perspective, if particles of particulate material PM are delivered to the core 3, substantially all of those particles will be recovered as heated particulate material PM.

3. FIG. 4 is slightly different from the schematic of FIG. 6. FIG. 6A shows vertical sections V of passage 6 and also sloped sections S. FIG. 4 shows that all sections are sloped. Thus, in FIG. 4, the flow mechanism resembles that of FIG. 5A. There is little or no free-fall of metal particles. The only free-fall which occurs is that as the particulate material PM falls.

Also, in FIG. 4, the passages 6 are serpentine, yet continuously downward-sloping and comprise a length of about 30 inches. Angle A in FIG. 4 is preferably between forty-five and seventy-five degrees. Angle θ in FIG. 12 is also preferably about 120 degrees.

Figure 13:
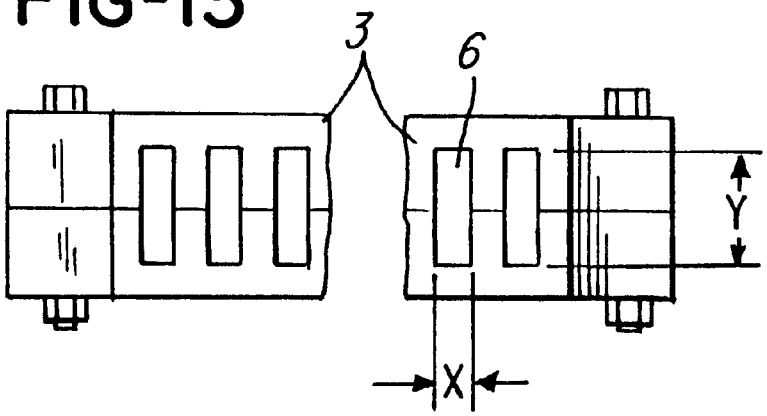
FIG. 13 is a plan view of a core, showing the shape of the passageways 6.

As best illustrated in FIG. 13, notice that the passages 6 each define a width X which is about 3 mm and a length Y which is about 12 mm.

Features of this invention may be used with apparatus and method disclosed in U.S. Pat. Nos. 5,611,230 and 5,611,139 and U.S. application Ser. No. 08/418,593 filed Apr. 6, 1995, all of which are assigned to the same assignee as the present invention and which are incorporated herein by reference and made a part hereof.

Numerous substitutions and modifications can be undertaken without departing from the true spirit and scope of the invention. What is desired to be secured by Letters Patent is the invention as defined in the following claims:

What is claimed is:

1. A particulate material heating apparatus for heating particulate material comprising:

a chute for receiving the particulate material;

an electrically responsive heating element having a plurality of heating elements which cooperate to define a plurality of serpentine passageways, said plurality of serpentine passageways being effective to heat a quantity of particulate material passing through said plurality of serpentine passageways such that substantially all said particulate material comes into contact with the electrically responsive heating element, thereby causing the particulate material to become heated to a desired temperature; and a control coupled to said electrically responsive heating element system for energizing said electrically responsive heating element to a predetermined temperature.

2. The apparatus as recited in claim 1 wherein said electrically responsive heating element comprises a plurality of serpentine passages.

3. A heat exchanger for heating particulate material comprising:

a heater core comprising a plurality of heating elements defining a plurality of separate serpentine passageways for receiving said particulate material;

an electrically responsive heater for heating said heater core to a predetermined temperature and a control system coupled to said heater core, said electrically responsive heater being responsive to said control system to facilitate maintaining said predetermined temperature in order to heat said particulate material to a desired temperature.

4. The heat exchanger as recited in claim 3 wherein each of said plurality of passageways is rectangular in cross section.

5. The heat exchanger as recited in claim 4 wherein each of said plurality of passageways defines a cross-sectional shape which defines a width of not more than 3 mm and a length of not less than 12 mm.

6. The heat exchanger as recited in claim 3 wherein each of said plurality of passageways comprising a length of more than 10 mm.

7. The heat exchanger as recited in claim 3 wherein each of said plurality of passageways comprise a plurality of serpentine passageways which are each continuously downward-sloping such that said particulate material falls through said plurality of serpentine passageways under the force of gravity.

8. The particulate material heater as recited in claim 7 wherein each of said plurality of serpentine passageways is rectangular in cross section.

9. The heat exchanger as recited in claim 3 wherein said particulate material comprises a powder metal.

10. The particulate material heater as recited in claim 3 wherein each of said plurality of passageways comprising a length of less than 30 mm.

11. The particulate material heater as recited in claim 10 wherein each of said plurality of passageways are each continuously downward-sloping such that said particulate material falls through said plurality of passageways under the force of gravity.

12. The particulate material heater as recited in claim 3 wherein each of said plurality of serpentine passageways defines a cross-sectional shape which defines a width of not more than 3 mm and a length of not less than 12 mm.

13. The particulate material heater as recited in claim 12 wherein said particulate material comprises a powder metal.

14. The particulate material heater as recited in claim 3 wherein said heater comprises a plurality of heating elements coupled to said core.

* * * * *